US005090786A

United States Patent [19]

Albiez et al.

[11] Patent Number: 5,090,786

[45] Date of Patent: Feb. 25, 1992

[54] DRAWER

[75] Inventors: Karl-Heinz Albiez, Dornbirn; Karl-Heinz Grabher, Lustenau, both of Austria

[73] Assignee: Alfit Aktiengesellschaft, Götzis, Austria

[21] Appl. No.: 616,781

[22] Filed: Nov. 20, 1990

[30] Foreign Application Priority Data

Nov. 20, 1989 [AT] Austria ..... 2642/89

[51] Int. Cl.[5] ..... A47B 88/00

[52] U.S. Cl. ..... 312/330.1; 403/279; 403/283

[58] Field of Search ..... 312/330.1, 348.1, 348.2; 403/283, 279

[56] References Cited

U.S. PATENT DOCUMENTS

| | | | |
|---|---|---|---|
| 4,527,933 | 7/1985 | Karhumaki et al. | 403/283 X |
| 4,842,351 | 6/1989 | Rock et al. | 312/330.1 X |
| 4,875,746 | 10/1989 | Rock et al. | 312/330.1 |
| 4,875,747 | 10/1989 | Hollenstein | 312/330.1 |

FOREIGN PATENT DOCUMENTS

| | | | |
|---|---|---|---|
| 326865 | 1/1976 | Austria . | |
| 344361 | 7/1978 | Austria . | |
| 370304 | 3/1983 | Austria . | |
| 387701 | 3/1989 | Austria . | |
| 388651 | 8/1989 | Austria . | |
| 0322545 | 11/1988 | European Pat. Off. . | |
| 2555151 | 12/1925 | Fed. Rep. of Germany . | |
| 7532707 | 6/1976 | Fed. Rep. of Germany . | |
| 7516951 | 8/1976 | Fed. Rep. of Germany . | |
| 2702217 | 7/1978 | Fed. Rep. of Germany | 312/348.1 |
| 8111691 | 9/1981 | Fed. Rep. of Germany . | |
| 8634281 | 3/1987 | Fed. Rep. of Germany . | |
| 3805669 | 9/1988 | Fed. Rep. of Germany . | |
| 2169491 | 11/1985 | United Kingdom . | |

*Primary Examiner*—Kenneth J. Dorner
*Assistant Examiner*—Brian K. Green
*Attorney, Agent, or Firm*—Collard, Roe & Galgano

[57] ABSTRACT

A drawer having metal side walls comprises a bottom plate, which is supported on angled carrying flanges of the side walls. Each carrying flange has lanced retaining lugs, which are intended to extend into a groove of the bottom plate and after the bottom plate has been placed on the flange are adapted to be bent to assume a fixing position, in which the lugs extend into the material which constitutes one or both side faces of the groove. The retaining lugs are initially lanced to extend in the longitudinal direction of the flange and are adapted to be bent up transversely to the longitudinal direction of the flange and groove. Each lug has a root portion, which merges into the flange and is not wider than the groove. At a distance from the root portion the lugs are provided with lateral projections, which during the bending up of the lugs are in pressure contact with at least one side face of the groove and dig arcuate furrows into the side face.

7 Claims, 1 Drawing Sheet

DRAWER

BACKGROUND OF THE INVENTION

1. Field of the Invention

This invention relates to a drawer comprising metal side walls disposed on opposite sides of the drawer and provided at the top with guide rails constituting a part of guiding means for the drawer. The side walls have at the bottom an angled carrying flange for supporting a bottom plate of the drawer, which carrying flange comprises lanced retaining lugs for extending into a groove which extends in the bottom plate parallel to its edge in the region in which the bottom plate and carrying flange overlap. When the bottom plate has been placed, on the flange said lugs are bent into a fixing position, in which the lugs extend into the groove in the bottom plate.

2. Description of the Prior Art

Such a drawer is known from AT-A-388,651 and DE-A-38 05 669. Owing to the preferred mounting of the guide rail and owing to the provision of the carrying flange with the retaining lugs the side wall of the drawer has a multiple function so that additional fastening means for mounting the bottom plate of the drawer are not required. Owing to the provision of the grooves, it will be sufficient to adapt the bottom plate only as regards the distance of said grooves from the edge rather than also as regards the longitudinal spacing to the location at which the retaining lugs are provided, as will be required if apertures for receiving retaining means are provided in the flange. The bottom plate can simply be cut in the proper length from continuous plate stock having a suitable width, and retaining portions of the retaining lugs can dig into the side face of the groove at a distance from the free edge of the groove so that the material of the bottom plate remains intact between the portion engaged by the lugs and the free edge of the groove and the full carrying capacity of said material will thus be preserved.

In the known design said advantages are offset by some serious disadvantages. In the known design the retaining lugs have been lanced along lines of cut extending from the free edge of the flange transversely to the longitudinal direction of the flange and are tapered to a point adjacent to their free edge and have been bent to form a claw. Besides, the retaining lugs are bent up during the manufacture of the side wall to such an extent that the inner edge of the bend provides a support for the outer free edge of the groove and the claw of the retaining lug can be inserted into the groove of the bottom plate which has been placed on the flange. When the bottom plate has been placed on the flange, a tonglike or spreading tool which is backed by the side wall is used to bend the retaining lugs to a position in which said lug is parallel to the side face of the groove and optionally engages the side face of the groove and the claw is then forced into the side face of the groove. An automation of that bending operation is difficult. As the retaining lugs have partly been bent up, it is difficult to nest the side members for transportation because the bent claws of the retaining lugs might hook into each other. As a result, a large space is required for the transportation of the side walls and the distance of the grooves from the edges of the bottom plate must be within very small manufacturing tolerances.

The disadvantages which have been pointed out or even more severe disadvantages will arise in other drawers, which have side walls provided with carrying flanges and retaining lugs extending into grooves of the bottom plate. From GB-B-2,169,491 it is known that retaining lugs can also be bent about bend lines which are parallel to the longitudinal direction of the flange in such a manner that the height of the bent-up portion of said retaining lugs slightly exceeds the depth of the groove which has a small width substantially adapted to the width of the lug. In that case the retaining lugs forced into the bottom of the groove as the lugs are forced onto the bottom plate. In that case a satisfactory anchoring of the retaining lugs in the groove, i.e., on the plate, will be ensured. For this reason it is known from DE-U-86 34 281 in connection with a similar design to provide the retaining lugs at their free (top) edge with a harpoon profile, which will dig into the wall of the groove as the bottom plate is forced onto the flange. In that case the bottom plate is forced onto the flange in a direction which is normal to the main plane of the bottom plate and the side face of the groove is damaged and forced away from the free edge of the groove by the harpoon edge so that a satisfactory fixation cannot be achieved.

For this reason it is proposed in EP-A-0 3 22 545 that the groove in the bottom plate should be somewhat wider and lanced retaining lugs should be bent up about bend lines extending at an acute angle to the longitudinal direction of the flange so that said lugs extend obliquely to the groove and the longitudinal edges of the lugs will dig into the side faces of the groove as the bottom plate is forced onto the flange. In that case the assembling will be simpler but the edges of the retaining lugs will cut straight longitudinal furrows into the side faces of the grooves so that slide-in beads which are open toward the free edge of the groove will be formed and a satisfactory clamped fit will not be ensured. In all designs described the retaining lugs are bent up during the manufacture of the side walls so that the upstanding lugs adversely affect the nestability of the side walls. All these side walls do not permit a mounting of bottom plates having no corresponding grooves.

From AT-A-387,701 it is known that a drawer rail of means for guiding a drawer can be secured to a wooden side wall of the drawer by means of lugs which have been bent from a flange of the drawer rail and have barblike pointed ends and are forced into the material of the side wall together with the rail. In accordance with DE-U-81 11 691 a guide rail of a drawer is secured to side walls consisting of wood by means of bent up lugs which enter a groove of the side wall. In accordance with DE-U-75 16 951 a rail is integrally formed with flat pegs, which are friction fit in slots having flat sides engaged by side faces of the pegs so that the pegs are clamped there. DE-A-25 55 151 discloses a mounting of angle bars by bent-out claws. In accordance with DE-U-75 32 707 a guide rail of a drawer is provided with spaced apart lugs, which have been lanced from a flange and are undercut and by which a fixing bar formed on a side wall is forced as a clamping fit against a rail flange which engages the other edge of said wall. Finally, it is known from AT-A-326,865, -344,361 and -370,304 to provide drawer side walls of wood with roller-guiding rails, which are fixed in grooves of said side walls by means of lugs which are integrally formed with the rail and which are spread out into the groove after the rail has been inserted.

SUMMARY OF THE INVENTION

It is an object of the invention to provide a drawer which is of the kind described first hereinbefore, in which the basic advantages stated are preserved and which permits a reliable fixation of the bottom plate to the frame with simple tools, a nesting of the frames and, optionally, a mounting of the bottom plate also by different fastening means.

The retaining lugs initially extend in the longitudinal direction of the flange and are then bent up transversely to the longitudinal direction of the flange. The lugs initially extend in the plane of the retaining flange throughout the length of the lugs before the frame and the bottom plate are joined, and in that state the lugs merge into the flange by a root portion which provides a bend line and has a width that is not wider than the groove. The free ends of the lugs have laterally and/or are provided with lateral projections spaced from said root portion, and said or projections are arranged to dig into at least one side face of the groove so as to form arcuate furrows therein as the retaining lugs are bent up.

In the drawer in accordance with the invention the bottom plate is placed on the flange of the side wall before the retaining lugs are bent into the groove. As a result, the retaining lugs will not obstruct a nesting of a plurality of side walls and if it is desired to fix the bottom plate by other means than the retaining lugs, in which case the bottom plate has no grooves, it can simply fastened to the flange in spite of the retaining lugs provided on the flange. Because simple tools may be used to bend up the lugs, the bottom plate may be mounted automatically by means of simple apparatuses. If the undercut or the projections is or are provided on the lugs only on the side facing the adjacent side wall, the edge of the bottom plate will firmly be forced against the side wall as the lugs are bent up. If the material of the bottom plate is weakened by the furrows, such weakening will be effected in an arcuate region beside the bent-up lug and the bottom plate will remain intact in that region which is disposed between the root portion of the bent up lugs and that region which is engaged by the edge portions or projections of the lugs so that the full carrying capacity of the bottom plate will be preserved in that region. The arcuate forced in furrows extend in a direction which differs from the direction in which forces are exerted from below in the usual operation of the drawer by end stops for the drawer or as a result of a loading or raising of the drawer so that a loosening of the lugs by such forces need not be feared.

In a preferred embodiment the retaining lugs have arrowheadlike free end portions. In that case those portions of the arrowhead which laterally protrude beyond the adjoining portion of the lug are intended to dig into the side faces of the groove. The printed end of the arrow may optionally engage the bottom of the groove. Regardless of the shape of the projections, they may be reversely bent opposite to the direction in which the projection is being bent as the projections are driven into the side face of the groove. That reverse bending will not constitute a disadvantage because barblike extensions will thus be formed and will result in an improved anchoring. That reverse bending of projections may be promoted in that the lugs are having thinner portions or intended bend lines at the roots of the projections.

In a different embodiment the retaining lugs have toothlike projections, which are spaced from the intended bend line provided in the root portion. Each lug may be formed on one side edge or each of both side edges with one, two or more of said projecting teeth.

The projections of the lugs may have the shape of sawteeth having steep side edges facing the intended bend line provided in the root portion. That design will facilitate the digging of furrows into the side faces of the groove so that an effective anchoring will be achieved.

In a different embodiment the retaining lugs are formed on the inner side edge, which faces away from the adjacent side wall, with one or more clawlike or toothlike projections and on the outer side edge, which faces the adjacent side wall, with undercut clamping projections which have outer edges which have a smaller inclination to the longitudinal direction of the lug than the outer edges of the claws or teeth. In that case the clamping projections substantially serve to force the side wall against the outer side face of the groove in the bottom plate and the claws act like barbs, which prevent a lifting of the bottom plate from the flange.

In accordance with a preferred feature the retaining lugs initially consist of one or more pairs of mutually oppositely extending, equal and opposite, lanced retaining lugs having bendable end portions directed toward each other. In that case the retaining lugs of each pair can be bent up by equal and opposite bending operations at the same time with one and the same tool so that the forces which are exerted in the longitudinal direction of the groove as the projections are forced into the side faces of the groove will offset each other.

In accordance with a further feature of the invention the carrying flange is formed with through openings for receiving retaining screws. That design will permit the use of standard side walls which can be combined with bottom plates that can be fixed by means of the lugs or with bottom plates that can be fixed with screws or the like fastening means.

Further details and advantages of the invention will become apparent from the subsequent description of the drawing.

DETAILED DESCRIPTION OF THE PREFERRED EMBODIMENTS

Figure 1:
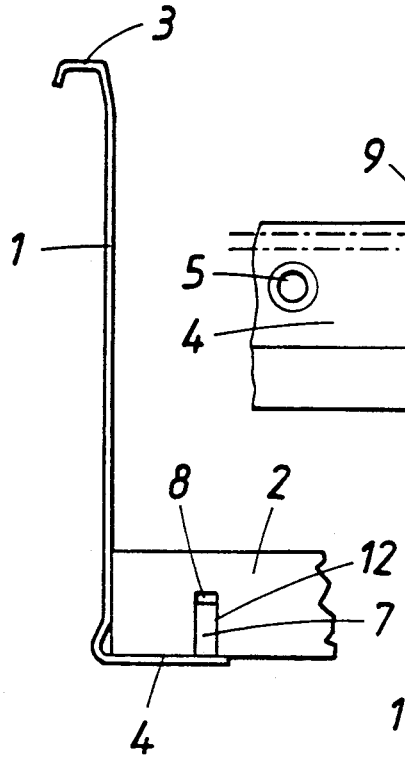
FIG. 1 is an elevation showing a portion of a drawer which comprises side walls and a bottom plate.

Embodiments of the invention will now be described with reference to the drawing.

The drawer shown in FIGS. 1 to 4 comprises metal side walls 1 and a wooden bottom plate 2.

The wooden bottom plate has opposite side edges and a bottom surface. The bottom surface has a pair of grooves extending parallel to the opposite side edges. Each groove has a first side face and a second side face. The distance between the first and second side faces defining the width of the groove. The side walls 1 define the sides of the drawer. Front and rear end plates and additional parts of the guiding means are not shown. Each side wall 1 is integrally formed at its top with a guide rail 3, which constitute a part of said guiding means for the drawer. Such means for guiding the drawer may comprise rollers provided on the side wall 1 below the rail 3.

The side wall 1 is provided at its bottom with an angled carrying flange 4 for supporting a side edge of the bottom plate 2. That carrying flange may be formed with through openings 5, 6 (see FIG. 2) for receiving fixing screws or plugs if it is intended to use such fasteners instead of, or in addition to, the lugs in accordance with the invention as means for fixing the bottom plate 2 to flange 4.

Figure 2:
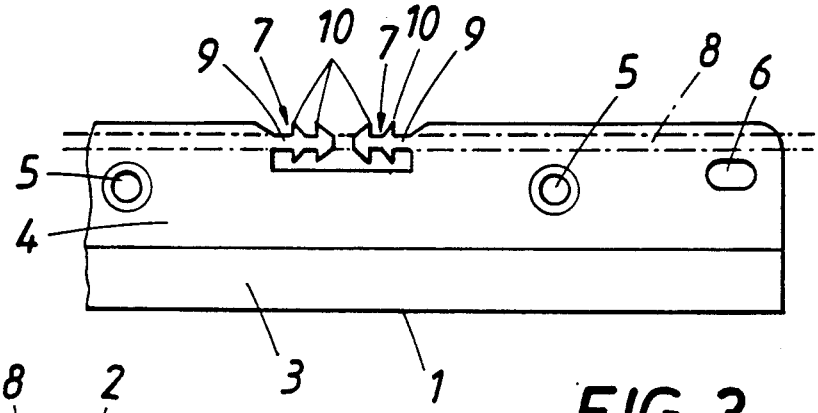
FIG. 2 is a top plan view showing the side wall of the drawer of FIG. 1.
Figure 3:
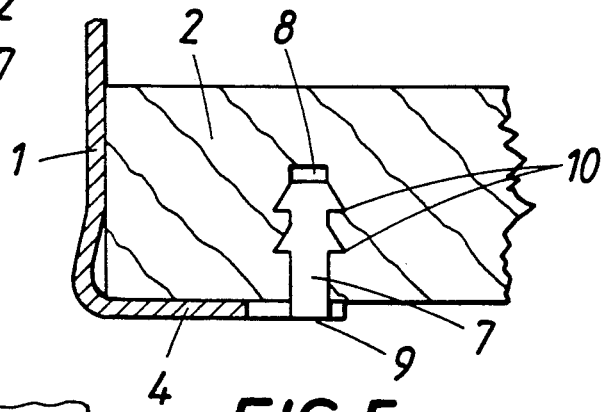
FIG. 3 is an enlarged transverse sectional view showing the bottom portion of the side wall and the bottom plate of the drawer with the retaining lugs in fixing position.
Figure 4:
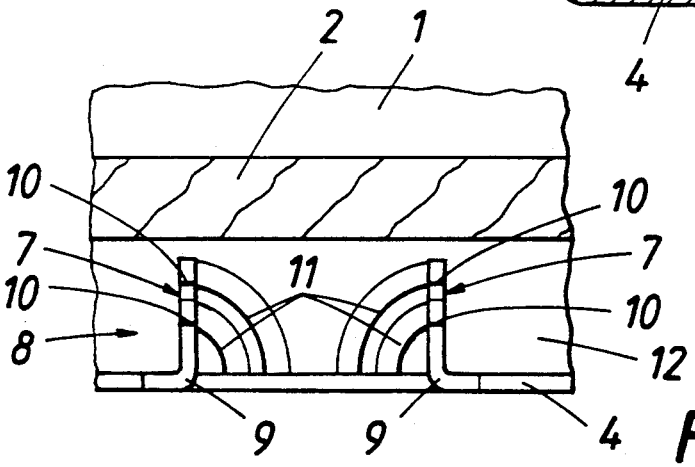
FIG. 4 is a longitudinal sectional view showing the groove of the bottom plate with the retaining lugs in the fixing position, as shown in to FIG. 3.

The carrying flange 4 is formed with pairs of retaining lugs 7 at two or more longitudinally spaced apart locations. Said retaining lugs are intended to extend into a groove 8, which is formed in the bottom plate 2 at a distance from the adjacent side edge of the bottom plate. Each pair of lugs 7 consists of two identical lugs 7 extending towards each other in the longitudinal direction of the flange root portion 9 connects each lug 7 to flange 4 and provides a bend line. The width of the root portion 9 is equal to, or smaller than, the width of the groove 8. As is shown in FIGS. 2 to 4, each lug 7 is provided at both side edges at locations spaced from the root portion 9 with projections 10 having the configuration of sawteeth, which have steep side edges facing the root portion 9.

The side wall 1 is delivered in a state in which the retaining lugs 7 are flush with the plane of the flange. When the carrying flange has been engaged with the bottom plate 2, which is backed on its top side, the retaining lugs 7 are bent up about their bend lines 9, and the lugs are thus moved to the fixing position shown in FIGS. 1, 3 and 4. As a result, the toothlike projections 10 dig arcuate furrows 11 into the side faces 12 of the groove. The two retaining lugs 7 of each pair are jointly bent to the fixing position.

Figure 5:
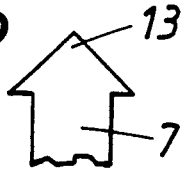
FIG. 5 is an elevation showing a modified retaining lug.
Figure 6:
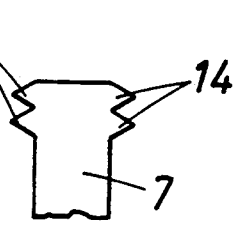
FIG. 6 is an elevation showing a further modified retaining lug.

In accordance with FIG. 5 the free end of a retaining lug 7 may have the configuration of an arrowhead 13. In accordance with FIG. 6 the lug 7 is not formed with sawtoothlike projections 10 but with teeth 14 having the basic configuration of isceles triangles. In another embodiment, the lugs may have straight or concavely curved side edges and may taper in width in the direction from the free end to the root portion.

Figure 7:
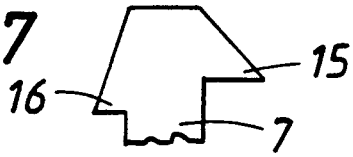
FIG. 7 is an elevation showing a different modified retaining lug.

In the embodiment shown in FIG. 7 the retaining lug 7 is provided with a clawlike projection 15 on its inner side edge, which faces away from the adjacent side wall. Alternatively, projections or claws which correspond to the projections 10 of FIGS. 1 to 4 or the projections 14 of FIG. 6 may be provided on that inner side edge of the retaining lug. On the outer side edge, which faces the adjacent side wall, the retaining lug 7 is provided with an undercut clamping projection 16, which has a longitudinal side edge which has a much smaller inclination than the longitudinal side edge of the claw 15 and suitably projects to a smaller extent from the adjoining side edge of the lug 7 than the longitudinal side edge of the claw 15. During the bending of the lug 7, the projection 16 serves mainly to clamp the edge of the bottom plate 2 against the side wall 1 whereas the claw 15 will then penetrate the plate material to a larger depth and will prevent a lifting of the plate 2 from the flange 4.

We claim:

1. A drawer comprising:

(a) a wooden bottom plate having opposite side edges and a bottom surface having a pair of grooves extending parallel to the opposite side edges, each groove having a first side face and a second side face, the distance between the first and second side faces defining the width of the groove, and (b) two opposite metal side walls having top and bottom edges, the side walls extending adjacent, and parallel, to the side edges of the bottom plate, each metal side wall comprising (1) a guide rail at the top edge and (2) a bottom plate carrying flange at the bottom edge, the carrying flange extending in a longitudinal direction along the side wall and substantially perpendicularly thereto, the bottom plate carrying flange engaging the bottom surface of the bottom plate and covering the groove therein, and (3) retaining lugs integral with the carrying flange and arranged in alignment with the groove, each retaining lug having a free end, a root portion merging into the carrying flange, the root portion providing a bend line extending transversely to the longitudinal direction and having a width not exceeding the width of the groove, the retaining lug being bent from an initial position wherein the retaining lug extends in the longitudinal direction and is flush with the carrying flange into a bottom plate retaining position wherein the retaining lug extends into the groove transversely to the longitudinal direction, and a portion wider than the width of the groove arranged between the free end and the root portion, the wider portion digging into at least one side face of the groove upon bending the retaining lug from the initial into the retaining position and forming at least one arcuate furrow into the side face.

2. The drawer of claim 1, wherein the wider portion comprises teeth extending laterally from the retaining lug.

3. The drawer of claim 2, wherein the teeth have the configuration of sawteeth.

4. The drawer of claim 1, wherein the retaining lug has respective side edges facing the side faces of the groove, and the wider portion comprises a first lateral projection projecting from the side edge facing the second side face of the groove, the first projection having an outer edge inclined with respect to the longitudinal direction and ending in a point adapted to dig into the second side face, and a second lateral projection projecting from the side edge facing the first side face of the groove, the second projection having an outer edge extending at an inclination with respect to the longitudinal direction of a smaller angle than the outer edge of the first projection.

5. The drawer of claim 4, wherein the first and second projections are claws.

6. The drawer of claim 1, wherein each carrying flange comprises at least one pair of identical ones of said retaining lugs, the free ends of the retaining lugs of each pair facing each other in the initial position.

7. The drawer of claim 1, wherein each carrying flange defines through openings adapted to receiving fixing screws for fastening the bottom plate to the carrying flanges.

* * * * *